US009505111B2

(12) United States Patent
Dorsey

(10) Patent No.: US 9,505,111 B2
(45) Date of Patent: Nov. 29, 2016

(54) TRIM REMOVAL TOOL AND METHOD

(71) Applicant: Scott A. Dorsey, Lakewood, CO (US)

(72) Inventor: Scott A. Dorsey, Lakewood, CO (US)

( * ) Notice: Subject to any disclaimer, the term of this patent is extended or adjusted under 35 U.S.C. 154(b) by 73 days.

(21) Appl. No.: 14/205,989

(22) Filed: Mar. 12, 2014

(65) Prior Publication Data

US 2014/0259605 A1 Sep. 18, 2014

Related U.S. Application Data

(60) Provisional application No. 61/782,018, filed on Mar. 14, 2013.

(51) Int. Cl.
*B25B 27/14* (2006.01)
*B25B 27/00* (2006.01)

(52) U.S. Cl.
CPC ..... *B25B 27/0092* (2013.01); *B25B 27/0035* (2013.01); *Y10T 29/49822* (2015.01); *Y10T 29/53835* (2015.01)

(58) Field of Classification Search
CPC ..... B25B 27/0092; B25B 27/0035; B25B 27/0028; B25B 27/02; B25B 33/00; Y10T 29/49822; Y10T 29/53385; A47L 13/08
See application file for complete search history.

(56) References Cited

U.S. PATENT DOCUMENTS

| | | | | |
|---|---|---|---|---|
| 2,593,304 | A * | 4/1952 | Howard | A01K 55/00 15/236.05 |
| 3,523,314 | A * | 8/1970 | Homins | A01K 55/00 449/34 |
| D314,321 | S | 2/1991 | Johnston | |
| 6,893,004 | B2 | 5/2005 | Ploeger | |
| 6,994,322 | B1 | 2/2006 | Wittman | |
| 7,147,209 | B2 * | 12/2006 | Jones | B25B 27/0092 254/25 |
| D567,052 | S * | 4/2008 | Vandenberghe | D8/47 |
| 2005/0193539 | A1 * | 9/2005 | Payne | B25B 27/0092 29/235 |
| 2006/0137159 | A1 * | 6/2006 | Jones | B25B 27/0092 29/235 |
| 2008/0035900 | A1 | 2/2008 | Flores | |

* cited by examiner

*Primary Examiner* — David Bryant
*Assistant Examiner* — Jun Yoo
(74) *Attorney, Agent, or Firm* — Pierson IP, PLLC

(57) ABSTRACT

Embodiments described herein are configured to release and remove window belt molding.

10 Claims, 6 Drawing Sheets

TRIM REMOVAL TOOL AND METHOD

CROSS-REFERENCE TO RELATED APPLICATIONS

This application claims a benefit of priority under 35 U.S.C. §119 to Provisional Application No. 61/782,018 filed on 14 Mar. 2013, entitled "TRIM REMOVAL TOOL AND METHOD," which is fully incorporated herein by reference in its entirety.

TECHNICAL FIELD

This disclosure relates generally to a tool which may be utilized to effect the removal of window belt molding from the window opening or frame in the body of a motor vehicle.

BACKGROUND

Conventionally, window belt molding (sometimes referred to as window belt trim) is removed with any number of tools that release the molding from various types of fastening mechanisms that may vary by car manufacturer. The removal of the molding is necessitated in the event an automobile vehicle is damaged. In order for an automobile body shop to properly warranty their work, the window belt molding must be removed before repainting a vehicle body. This allows the vehicle body to be fully repainted under the removed window belt moldings.

However, removal of the window belt molding is rendered difficult by fastening mechanisms, and if the window belt molding or fastening mechanisms are damaged, they may need to be replaced.

Conventional tools for removing window belt molding are unable to release window belt moldings that utilize certain methods of fastening themselves to the car door frame, such as window belt moldings without clips that hook onto a downward pointing flange in the door frame, hereafter referred to as clip-less window belt moldings. A typical clip-less window belt molding will fasten to a downward pointing flange on the inside of the door frame. The clip-less window belt molding fits between the car window and the car door frame, and has an upward pointing flange that curls towards the car door and mates with the car door frame's downward pointing flange.

It can be challenging to remove clip-less window belt moldings with existing tools because of the shape of the existing tools. Existing tools have squared heads that are poorly equipped to initiate release of the upward pointing flange on a clip-less window belt molding. Further, upon initial release of the clip-less window belt molding's upward pointing flange, the majority of the clip-less window belt molding's upward pointing flange is still engaged with the car door frame's downward pointing flange and must be released. This poses an additional challenge to removal, because clip-less window belt moldings include design features to prevent the clip-less window belt molding's upward pointing flange from becoming unfastened from the car door frame's downward pointing flange easily. If one small section of the clip-less window belt molding's upward pointing flange becomes unfastened, it would be easy for the entire flexible clip-less window belt molding to "unzip" itself from the car door frame's downward pointing flange, i.e., the released portion of the clip-less window belt molding would easily pull the rest of the clip-less window belt molding out from under the car door frame's downward pointing flange with minimal upward force.

To prevent this accidental "unzipping", manufacturers incorporate design features into the fastening system, e.g., periodic recessions in the car door frame's downward pointing flange. These recessions act as a "rip-stop", arresting the unfastening of the clip-less window belt molding's upward pointing flange. This design feature renders releasing of the entire clip-less window belt molding without additional tools and without damaging the clip-less window belt molding very difficult.

Accordingly, needs exist for more efficient and effective removal of window belt molding.

SUMMARY

Embodiments described herein are configured to release and remove window belt molding.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions, or rearrangements may be made within the scope of the invention. The invention includes all such substitutions, modifications, additions or rearrangements.

BRIEF DESCRIPTION OF THE DRAWINGS

The drawings accompanying and forming part of this specification are included to depict certain aspects of the invention. A clearer impression of the invention, and of the components and operation of systems provided with the invention, will become more readily apparent by referring to the exemplary, and therefore nonlimiting, embodiments illustrated in the drawings, wherein identical reference numerals designate the same components. Note that the features illustrated in the drawings are not necessarily drawn to scale.

Figure 1A:
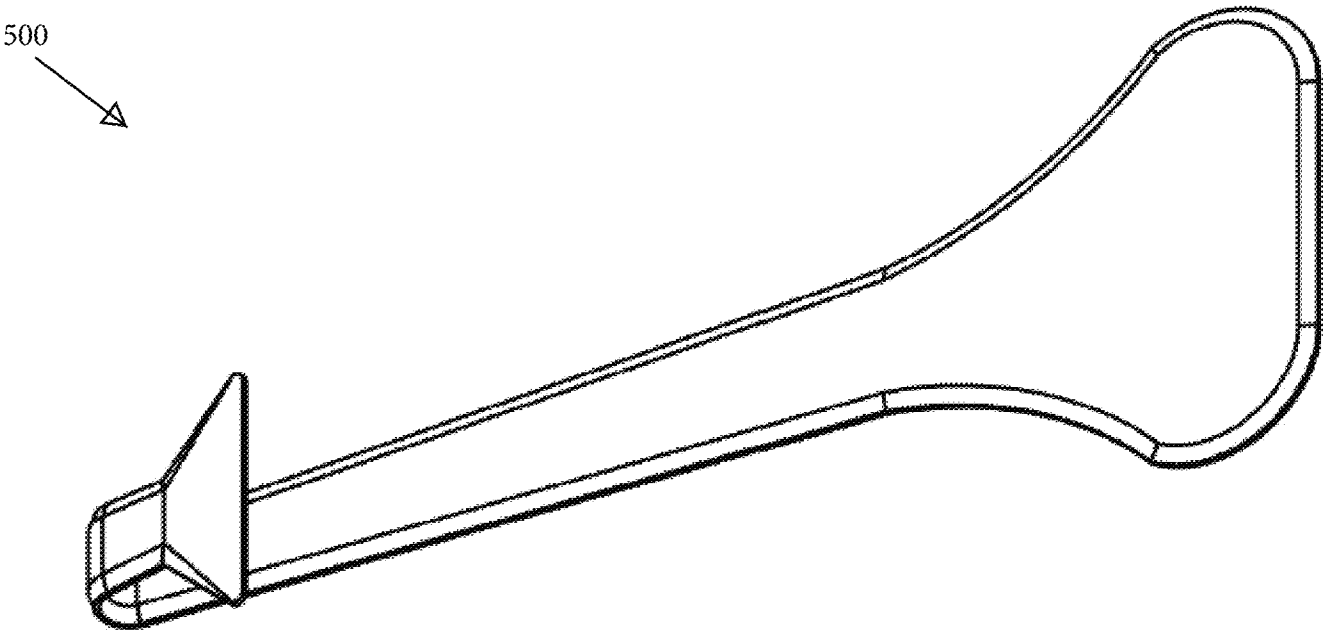
FIG. 1A depicts a trim removal tool, according to an embodiment.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention.

DETAILED DESCRIPTION

The invention and the various features and advantageous details thereof are explained more fully with reference to the nonlimiting embodiments that are illustrated in the accompanying drawings and are detailed in the following description.

The word "exemplary" is used herein to mean "serving as an example, instance, or illustration." Any embodiment described herein as "exemplary" is not necessarily to be construed as preferred or advantageous over other embodiments.

FIG. 1A depicts one embodiment of a window belt molding removal tool 500 (referred to hereinafter as "tool 500"). Tool 500 may be configured to remove car door window belt moldings (referred to hereinafter as "moldings") from cars. Tool 500 may be configured to fit between the molding and car door frame flange. With substantially less effort than prior approaches, the tool 500 releases the molding from the car. As depicted, it has a substantially flat handle allowing it to fit into tight areas.

Figure 1B:
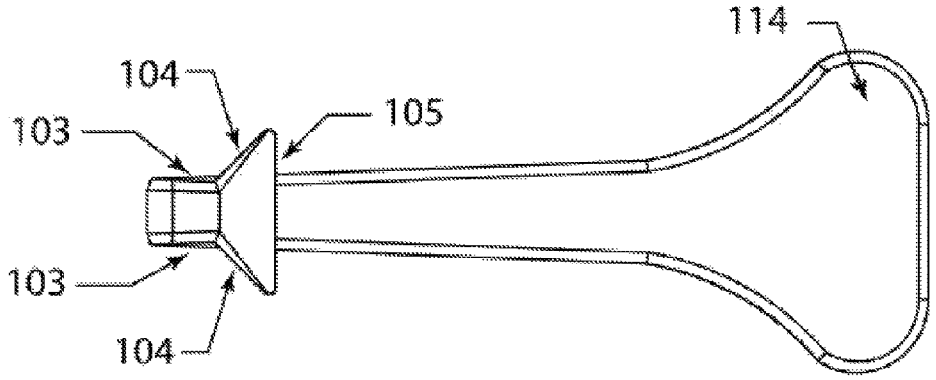
FIG. 1B depicts a trim removal tool, according to an embodiment.

FIG. 1B depicts one embodiment of tool 500. As depicted in FIG. 1B tool 500 may include a grip portion 114, a handle 106, and a distal portion 100.

Grip portion 114 may be configured to be positioned on a first end of tool 500. Grip portion 114 may be configured to receive force from a user, and may include a front face that widens as grip portion 114 extends away from handle 106. However, in other embodiments, handle 106 may be configured in various shapes and/or sizes.

Handle 106 may be a projection extending away from grip portion 114 to distal portion 100. In embodiments, handle 106 may be planar or substantially planar to the front face of grip portion 114.

Distal portion 104 may be a tool configured to remove moldings, and distal portion 104 may be positioned on a second end of tool 500. Distal portion 104 may be configured to insert in-between a car door and molding to remove the moving. Distal portion 104 may include triangular shaped head 102, edges 103, 104, 105, gap 108, and a curved tip 112.

Triangular shaped head 102 may be positioned a head positioned on and end of distal portion 104. Triangular shaped head 102 may have a shape such that as triangular shaped head extends away from tip 112, the height of triangular shaped head decreases to form a wedge. The wedge formed by triangular shaped head 102 may include edges 104 and 105. Edges 104 may be configured to project away from edges 103 to increase the surface area of edge 105. In embodiments, edge 105 may have a length that is greater than the length of handle 106. As depicted, the distal end 100 in this embodiment of the tool has a triangular shaped head 102 that is also wedge shaped on its edges 104 and 105. Edge 105 allows the tool 500 to insert itself between the car door and molding, and begins to release the molding from the fastening portions of the car door. 104 further helps "pop" the molding away from the fastening portions of the car door as the tool is maneuvered along the molding, this helps tool 500 release moldings from the car. For example, some car door frame flanges have periodic recessions that prevent the molding flange from easily releasing along the entire length of the molding. The edges along the rest of the tool may be wedge shaped, as shown at 103, to allow the tool to be easily maneuvered between the door and molding, and reduce the potential for damage to the door and molding. In the current embodiment, 105 is angled at 4°, and 103 and 104 are angled at 20°. These dimensions, however, are only exemplary of particular embodiments and it is contemplated that other dimensions may be implemented. Furthermore, the wedged edges 103, 104, and 105 improve the operation of the tool 500, but a tool 500 without wedged edges would still be functional. It is contemplated that the triangular head may take other shapes that similarly facilitate pulling the molding away from the fastening portions of the door. In general, an increase with width of the head is the feature that facilitates release of the molding flange from the car door frame flange.

Curved Tip 112 may be configured to be positioned on a second end of handle 106, such that handle extends from grip portion 110 to tip 112. Curved tip 112 may be a portion of distal portion 104 being configured to be curved, bend, etc. such that a face of edge 105 is facing handle 106 and grip portion 110. Distal portion 104 may be configured to be curved, bent, etc. at a degree between one hundred and thirty to two hundred and thirty degrees, such as one hundred seventy degrees, such that distal portion 104 may be able to hook under and around the molding.

As depicted in FIG. 1B, a portion of the distal end 100 with the head 102 is angled 10° to a handle portion 106, and a distance formed by a gap 108 between the head 102 and the handle portion 106 is relatively small to enable both the handle portion 106 and the head 102 to fit in tight spaces. The gap, however, is wide enough so a tip of the head 102 may extend under the molding and between the molding and the car door. In this way, the tool is specifically sized and configured to pull the molding from the car door. For example, the inner distance formed by the gap between the head 102 and the handle 106 may be between 0.6 inches and 0.2 inches, and in one embodiment the distance is about 5/16 of an inch. These dimensions, however, are only exemplary of particular embodiments and it is contemplated that other dimensions may be implemented.

In many implementations, the tool is made from metal, sheet metals, plastic, synthetic materials, or any other rigid material. To manufacture the tool, the metal may be obtained in sheets, in an annealed state, which is very malleable, and the sheets may be laser cut or stamped with a die, and bent (to form the distal end 100). The edges 103, 104, and 105 may be form by a stamping die or by grinding the ends of the head 102 with a grinder. The edges 103, 104, and 105 may then be sanded to form a smooth transition between the tips of the edges 103, 104, and 105 to the thicker portion of the distal end 100. The tips of the edges may also be softened for safety. The metal of the tool is then hardened by any of a variety of techniques, but in one method, the metal is heated and tempered so the metal is hardened without being too brittle. It is contemplated, however, that one of ordinary skill, in view of this disclosure, may manufacture the tool using a variety of different methodologies.

Figure 1C:
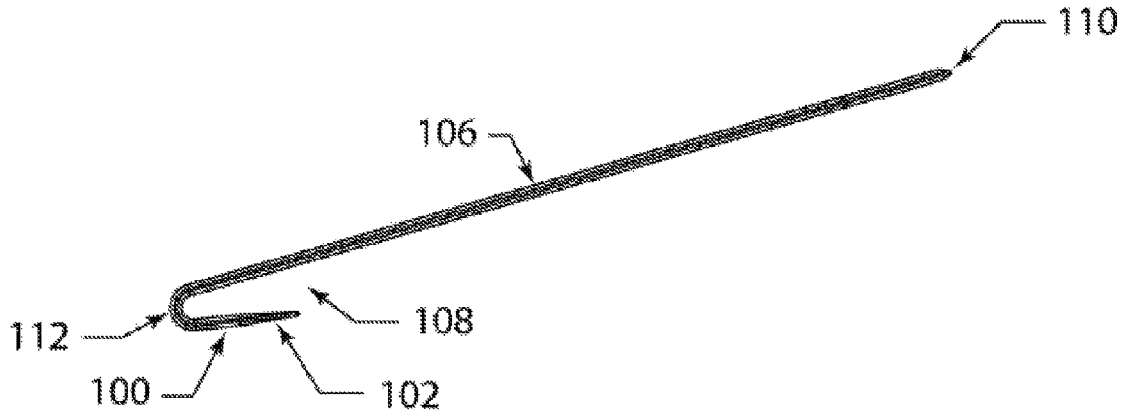
FIG. 1C depicts a trim removal tool, according to an embodiment.

As shown, the handle portion 106 in the exemplary embodiment depicted in FIGS. 1A-1C is substantially flat from a tip 110 of the proximal end to a tip 112 of the distal end. A grip portion 114, however, widens along a front face (as shown in FIG. 1B) near the proximal end to enable a user to better grip the tool. It is contemplated, however, that a variety of handle geometries may allow the tool to be operated effectively.

Figure 2A:
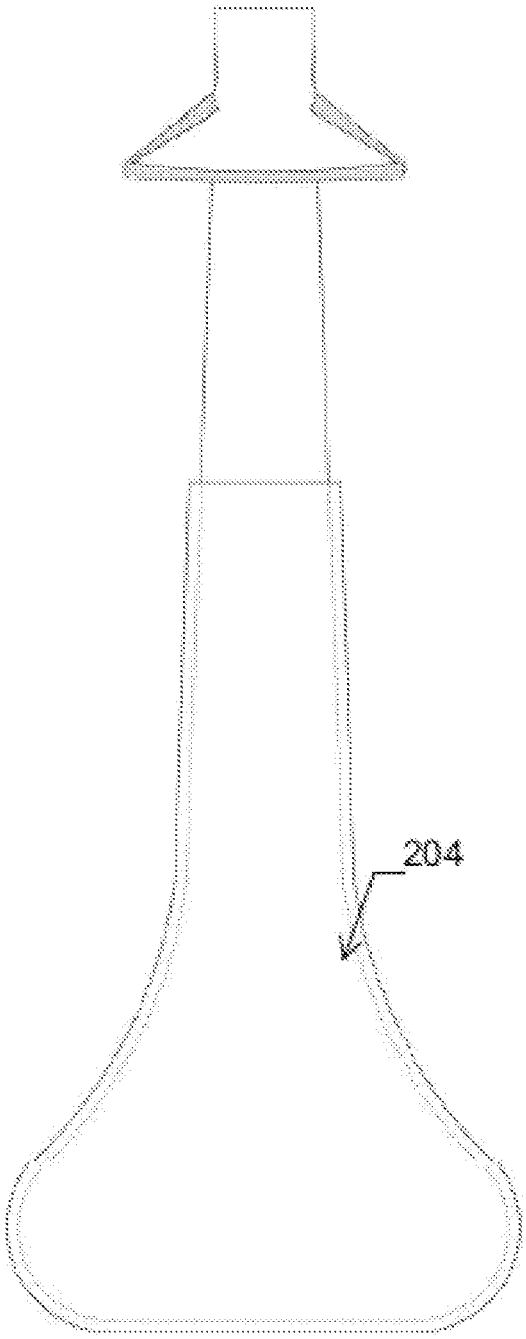
FIG. 2A depicts a trim removal tool, according to an embodiment.
Figure 2B:
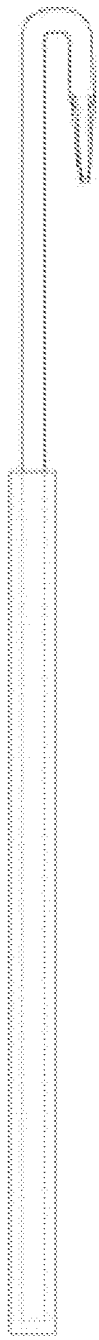
FIG. 2B depicts a trim removal tool, according to an embodiment.

Referring to FIGS. 2A and 2B shown are front and side views, respectively, of another embodiment of the tool that includes a handle overlay, which may be constructed of plastic or other suitable material.

Figure 3A:
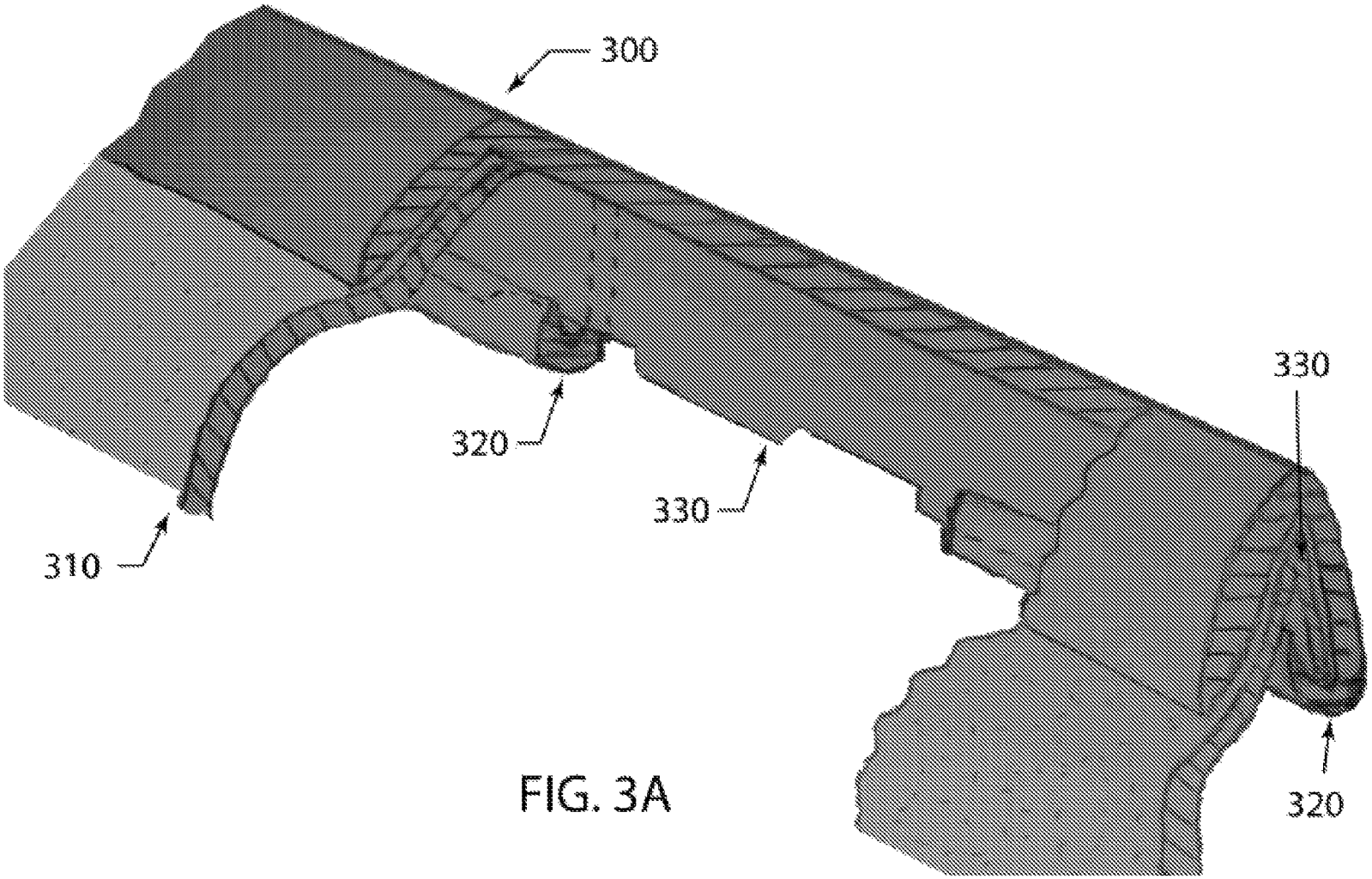
FIG. 3A depicts a window belt molding, according to an embodiment.

FIG. 3A depicts one embodiment of a window belt molding 300. Window belt molding 300 fastens to car door frame 310 by the molding flange 320 hooking onto the car door flange 330.

Figure 3B:
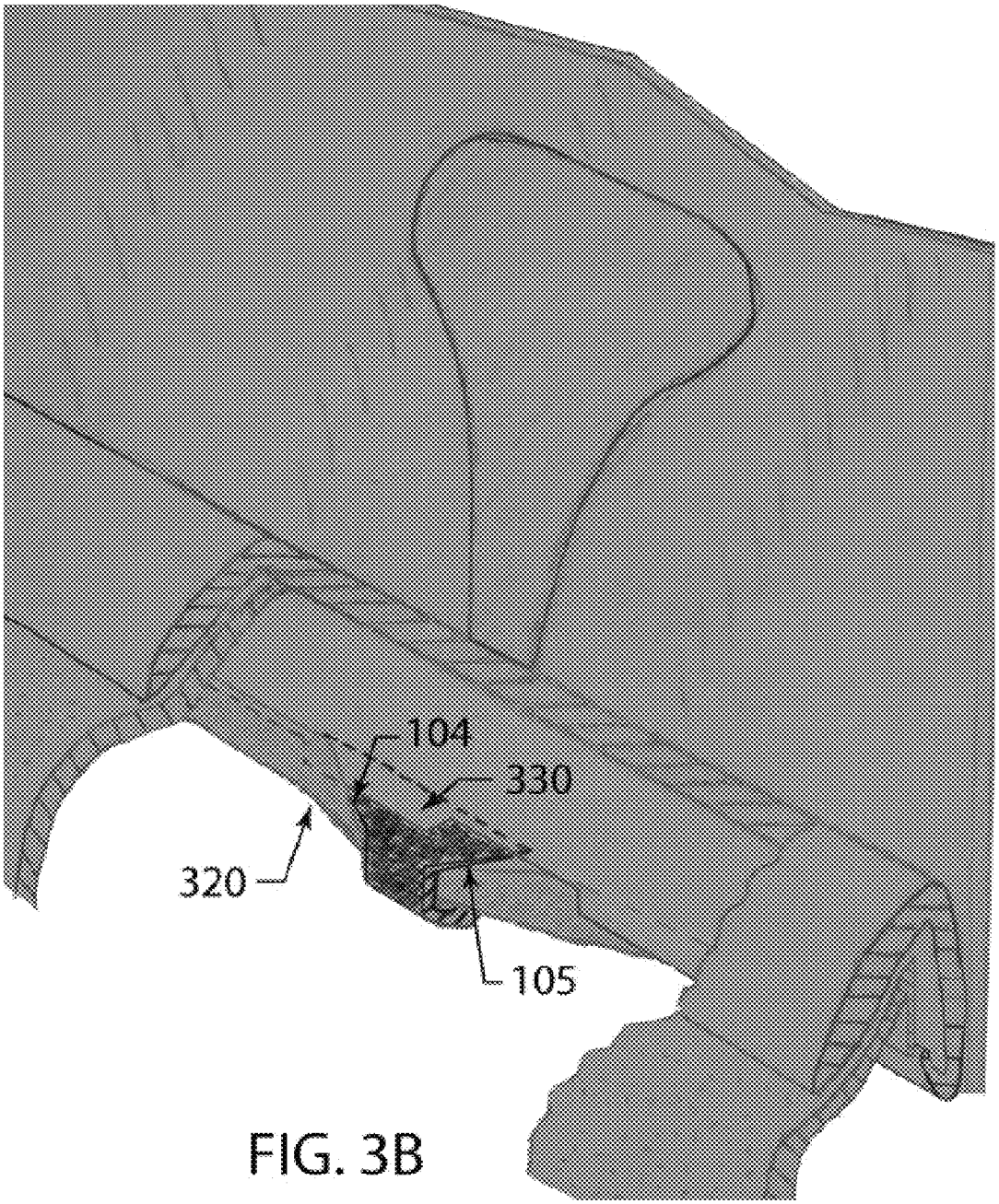
FIG. 3B depicts a trim removal tool interfacing with window belt molding, according to an embodiment.

FIG. 3B depicts a cut-a-way view of a car door and cut-a-way view of molding that has been partially unfastened from the car door by tool 500. Tool 500 has created initial separation between the molding flange from the car door frame flange, and is being maneuvered along the length of the molding flange to release the molding.

Figure 4:
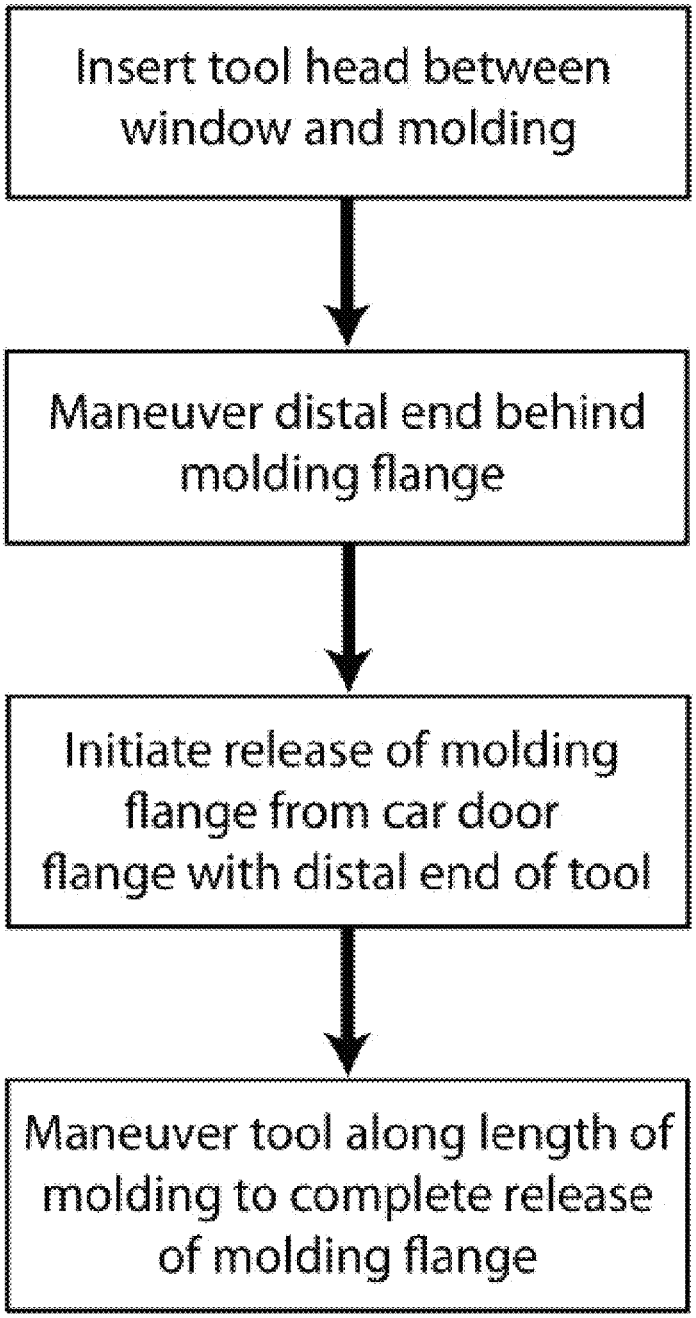
FIG. 4 depicts a method of using a trim removal tool, according to an embodiment.

FIG. 4 depicts a flow chart describing typical operation of the tool. Operation 1, a user holds the tool around the grip portion 114 and pushes the tool downward so that a tip of the head 102 is below a bottom portion of the molding flange 320. Operation 2, a user pulls the tool upward such that the head 102 is behind the molding flange 320, i.e. between the molding flange 320 and the car door frame 310. In this position, the end of the head 102 reaches a height above that of the bottom of the molding flange 320. Operation 3, the head 102 is used to initiate release of molding flange 320 from the car door frame flange 330 by a user pulling the head 102 towards the car window. While pulling head 102 towards the window, the user may need to rotate the tool in various directions to allow the head 102 to interpose itself between the molding flange 320 and the car door frame flange 330, as those skilled in the relevant art will recognize and appreciate. For example, one of the edges of the triangular head 104 may be used to hook the molding flange 320 by rotating the tool clockwise or counter-clockwise as it appears in FIG. 1B. Operation 4, to fully release the molding flange 320, tool 500 is slid along the length of the face of the car door frame flange 330. The increasing width of the head towards the distal end improves the ability of the tool to pull the molding away from the car door frame flange without damage to the molding or door. After Operation 4, the molding 300 is fully released and can be easily removed vertically, or otherwise, from the car door frame 310 along with the tool.

In the foregoing specification, embodiments have been described with reference to specific embodiments. However, one of ordinary skill in the art appreciates that various modifications and changes can be made without departing from the scope of the invention. Accordingly, the specification and figures are to be regarded in an illustrative rather than a restrictive sense, and all such modifications are intended to be included within the scope of the invention.

Descriptions of well-known starting materials, processing techniques, components, and equipment are omitted so as not to unnecessarily obscure the invention in detail.

It should be understood, however, that the detailed description and the specific examples, while indicating preferred embodiments of the invention, are given by way of illustration only and not by way of limitation. Various substitutions, modifications, additions and/or rearrangements within the spirit and/or scope of the underlying inventive concept will become apparent to those skilled in the art from this disclosure.

As used herein, the terms "comprises," "comprising," "includes," "including," "has," "having," or any other variation thereof, are intended to cover a non-exclusive inclusion. For example, a process, article, or apparatus that comprises a list of elements is not necessarily limited to only those elements but may include other elements not expressly listed or inherent to such process, article, or apparatus.

Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

Additionally, any examples or illustrations given herein are not to be regarded in any way as restrictions on, limits to, or express definitions of any term or terms with which they are utilized. Instead, these examples or illustrations are to be regarded as being described with respect to one particular embodiment and as being illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms. Language designating such nonlimiting examples and illustrations includes, but is not limited to: "for example," "for instance," "e.g.," and "in one embodiment."

Although the invention has been described with respect to specific embodiments thereof, these embodiments are merely illustrative, and are thus not restrictive of the invention. The description herein of illustrated embodiments of the invention is not intended to be exhaustive or to limit the invention to the precise forms disclosed herein (in particular, the inclusion of any particular embodiment, feature, or function is not intended to limit the scope of the invention to such embodiment, feature, or function).

Rather, the description is intended to describe illustrative embodiments, features and functions in order to provide a person of ordinary skill in the art context to understand the invention without limiting the invention to any particularly described embodiment, feature, or function. While specific embodiments of, and examples for, the invention are described herein for illustrative purposes only, various equivalent modifications are possible within the spirit and scope of the invention, as those skilled in the relevant art will recognize and appreciate.

As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes, and substitutions are intended in the foregoing disclosures. It will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component.

What is claimed is:

1. A tool for removing window belt molding from a car door, the tool comprising:

a grip portion positioned on a first end of the tool, the grip portion being configured to receive force from a user;

a handle configured to extend away from the grip portion; and a distal portion of the tool including a curved end and a wedge, wherein the handle includes a planar surface extending from the grip portion to the curved end, the handle portion being tapered such that a width of the handle decreases in size from the grip portion to the distal portion, the curved end being configured to bend the distal portion back towards the handle such that a first portion of the curved end and a first portion of the wedge are covered by a bottom surface of the handle, the wedge being configured to interface with the window belt molding of the car door, the wedge having sides that project outward, wherein a first end of the wedge is positioned adjacent to the a second end of the first portion of the curved end and the first end of the wedge has a first width that is smaller than a width of the handle and a second end of the wedge has a second width that is greater than the width of the handle, the wedge gradually increasing in width from the first end of the wedge to the second end of the wedge such that at least a second portion of the wedge extends past the bottom surface of the handle covering the first portion of the wedge, wherein the sides of wedge are tapered, wherein the curved end is angled, the first width being smaller than the second width, wherein the sides of the first portion of the curved end are tapered edges.

2. The tool of claim 1, wherein a face of the wedge has a thickness that is greater than six hundredths of an inch.

3. The tool of claim 1, wherein a face of the wedge has a thickness that is less than one tenth of an inch.

4. The tool of claim 1, wherein the sides of the wedge project away from the curved end in a range of one degree to ninety degrees.

5. The tool of claim 1, wherein a face of the wedge is configured to be positioned between a door flange and a molding flange when the distal portion is inserted into the car door.

6. The tool of claim 5, wherein a face of the wedge is configured to be inserted between a window and the molding flange.

7. The tool of claim 6, wherein a face of the wedge is configured to be moved along a length of the molding flange to decouple the molding flange from the car door.

8. The tool of claim 5, wherein a face of the wedge is configured to move in a lateral direction along a face of the window.

9. The tool of claim 5, wherein a face of the wedge is configured to be inserted at the interface between the door flange and the molding flange.

10. The tool of claim 5, wherein the sides of the wedge are configured to be positioned adjacent to the molding flange when the tool is inserted between a window and the molding flange.

* * * * *